US006825845B2

(12) United States Patent
Nally

(10) Patent No.: US 6,825,845 B2
(45) Date of Patent: Nov. 30, 2004

(54) VIRTUAL FRAME BUFFER CONTROL SYSTEM

(75) Inventor: Robert M. Nally, McKinney, TX (US)

(73) Assignee: Texas Instruments Incorporated, Dallas, TX (US)

( * ) Notice: Subject to any disclaimer, the term of this patent is extended or adjusted under 35 U.S.C. 154(b) by 111 days.

(21) Appl. No.: 10/109,030

(22) Filed: Mar. 28, 2002

(65) Prior Publication Data

US 2003/0184550 A1 Oct. 2, 2003

(51) Int. Cl.[7] ..... G09G 5/36

(52) U.S. Cl. ..... 345/545; 345/87; 345/98; 345/531

(58) Field of Search ..... 345/125, 87, 501, 345/531, 544, 545, 620, 622, 1.1, 1.3, 98, 100, 204

(56) References Cited

U.S. PATENT DOCUMENTS 5,546,104 A * 8/1996 Kuga ..... 345/99
6,222,564 B1 * 4/2001 Sturges ..... 345/531
6,282,209 B1 * 8/2001 Kataoka et al. ..... 370/498
6,411,302 B1 * 6/2002 Chiraz ..... 345/544
6,583,771 B1 * 6/2003 Furuhashi et al. ..... 345/1.1
2002/0008682 A1 * 1/2002 Park ..... 345/87
2002/0070852 A1 * 6/2002 Trauner et al. ..... 340/438
2003/0048275 A1 * 3/2003 Ciolac ..... 345/544
2003/0074181 A1 * 4/2003 Gharavy ..... 704/1

* cited by examiner

*Primary Examiner*—Kee M. Tung
(74) *Attorney, Agent, or Firm*—William B. Kempler; W. James Brady, III; Frederick J. Telecky, Jr.

(57) ABSTRACT

A Virtual Frame Buffer control system and method for cascading several display controllers on one LCD panel. The Virtual Frame Buffer is composed of all the memory in all the controller/memory/source driver chips (in a tiled pattern) for the associated processor to read and write in. The control system also includes hardware clipping controls in each of the controller/memory/source driver chips. The Virtual Frame Buffer and hardware clipping control placement substantially reduces programming problems associated with prior art solutions for cascading LCD controller/memory/source driver devices.

23 Claims, 3 Drawing Sheets

VIRTUAL FRAME BUFFER CONTROL SYSTEM

BACKGROUND OF THE INVENTION

1. Field of the Invention

This invention relates generally to virtual frame buffer controls, and more particularly to a system and method for cascading several display controllers associated with one liquid crystal display (LCD) panel.

2. Description of the Prior Art

The display memory for LCD displays in cell phones and Personal Data Assistance (PDA's) are beginning to be integrated into the display timing controller and source driver chips that drive the LCD panels. Integration of this display memory into these chips is problematic however, since the drivers can no longer be cascaded in a manner such as done in personal computer (PC) LCD solutions. In PC LCD displays, a number of different display resolutions can be supported with the timing controller and source drivers by simple cascading a different number of drivers for each different size display. In the PC LCD display, this technique of cascading source drivers was developed so that only one timing controller chip and one source driver chip was all a silicon company had to produce to support all the different sizes of display panels on the market. But in the PDA market it is desirable to integrate the source driver, timing controller, and display memory into just one chip. This technique is problematic since it requires cascading the memory whenever it is desired to cascade the source drivers; and when the memory is cascaded, the processor generating the display image must be able to map every displayable pixel to the proper controller/memory/source driver. This requirement has proven to be extremely problematic (i.e. 'programming nightmare'), since even a simple operation such as drawing a line across a display image then requires a clipping window (implemented in software) for each controller/memory/source driver. This requirement for a software implemented clipping window associated with each controller/memory/source driver is extremely difficult to achieve due to the diverse types of buses that are used to interface the controller/memory/source driver devices to the processor. When data is sent to the controller/memory/source driver device, for example, there is no memory address associated with the data stream since the data has a predetermined destination. Further, the data transfer is generally implemented with a DMA controller. This means that if six controller/memory/source drivers are desired in the design, for example, the processor is required to cut the image being transferred into six pieces, and then program the DMA controller six different times to send the six different pieces to the six different controller/memory/source drivers.

SUMMARY OF THE INVENTION

The present invention is directed to a virtual frame buffer control system and method for cascading several display controllers on one LCD panel. The virtual frame buffer is composed of all the memory in all the controller/memory/source driver chips (in a tiled pattern) for the associated processor to read and write in. The control system also includes hardware clipping controls in each of the controller/memory/source driver chips. The virtual frame buffer and hardware clipping control placement substantially reduces programming problems associated with prior art solutions for cascading LCD controller/memory/source driver devices.

According to one embodiment, the associated processor reads and writes to the virtual memory; and each of the controller/memory/source driver devices will know when to capture its respective data off the data bus. This enables the processor to program the DMA controller such that the DMA controller will make only one transfer (the total uncut or uncropped image). Each controller/memory/source driver will monitor the data streaming across the bus and will know what portions of the two-dimensional image being transferred goes into it's own physical memory and what portions do not go into it's physical memory.

BRIEF DESCRIPTION OF THE DRAWINGS

Other aspects, features and attendant advantages of the present invention will be readily appreciated as the invention become better understood by reference to the following detailed description when considered in connection with the accompanying drawings in which like reference numerals designate like parts throughout the figures thereof and wherein.

While the above-identified drawing figures set forth alternative embodiments, other embodiments of the present invention are also contemplated, as noted in the discussion. In all cases, this disclosure presents illustrated embodiments of the present invention by way of representation and not limitation. Numerous other modifications and embodiments can be devised by those skilled in the art which fall within the scope and spirit of the principles of this invention.

DETAILED DESCRIPTION OF THE PREFERRED EMBODIMENTS

Figure 1:
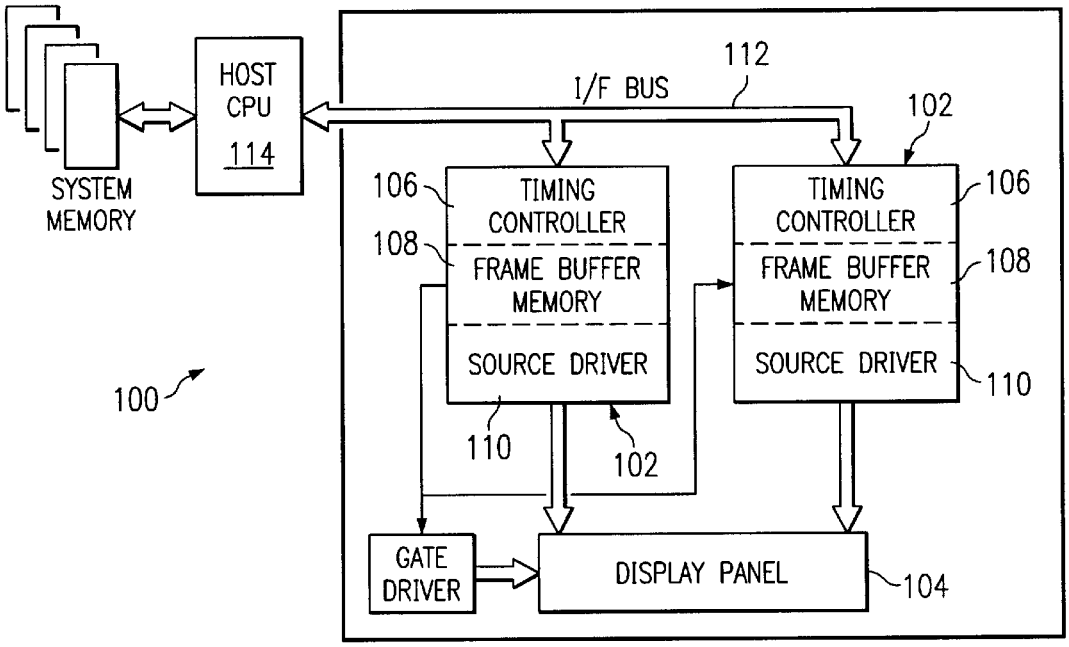
FIG. 1 is a high level block diagram illustrating a scheme for employing a plurality of Virtual Frame Buffer control systems suitable for cascading several display controllers on one LCD panel according to one embodiment of the present invention.

FIG. 1 is a high level block diagram illustrating a scheme 100 for employing a plurality of Virtual Frame Buffer control systems 102 suitable for cascading several display controllers on one LCD panel 104 according to one embodiment of the present invention. Each Virtual Frame Buffer control system 102 comprises a display timing controller 106, a frame buffer memory 108, and a source driver 110, all most preferably combined on one common substrate. An interface bus 112 provided by, for example, a flex cable, allows I/O communications between the Host CPU 114 and each Virtual Frame Buffer control system 102. The present invention is not so limited however, and it shall be understood that the Host CPU 114 could just as well be another type of data processing device such as, for example, a micro-controller, computer, micro-computer, or digital signal processor (DSP). The Virtual Frame Buffer control system 102 has cascading support, as stated herein before, so that different size display panels may take advantage of the Virtual Frame Buffer control system 102 technology. With continued reference to FIG. 1, it can be seen that each Virtual Frame Buffer control system 102 has a dedicated I/F, dedicated to a respective LCD display timing controller 106. Importantly, one Virtual Frame Buffer control system 102 is designated as a master device, while all other Virtual Frame Buffer control systems 102 in the multiple Virtual Frame Buffer control system scheme 100 are designated as slave devices.

Each Virtual Frame Buffer control system 102 supports a plurality of different Host CPU's. Signaling protocols supported by each Virtual Frame Buffer control system 102 most preferably include, but are not limited to, INTEL® 80 (MPU 80) and MOTOROLA® 68 (MPU 68) host CPU signaling protocols, the Texas Instruments LCD I/F (MPU xx) host CPU signaling protocol, and a straight raster signaling interface host CPU signaling protocol. The Raster interface is required to support host processors that still only drive data in a rastering fashion to "dumb" display controllers. Table 1 below shows a preferred embodiment of a Virtual Frame Buffer control system 102 pin arrangement that is suitable for supporting all the different parallel interfaces discussed above.

TABLE 1

Parallel Pin Mapping

| Pin Name | MPU 80 | MPU 68 | MPU xx | Raster |
|---|---|---|---|---|
| nCS | nCS | nCS | nCS | DE |
| D/nC | A[0] | A[0] | A[0] | Vsync |
| R/nW | nWR | R/nW | R/nW | Hsync |
| E | nRD | E | E | CLK |
| D[7:0] | D[7:0] | D[7:0] | D[7:0] | D[7:0] |
| D[15:8] | D[15:8] | D[15:8] | D[15:8] | D[15:8] |
| D[17:16] | NC | NC | NC | D[17:16] |

It should be noted here that the MPU 80, MPU 68, and Raster configurations are existing bus configurations that do not take advantage of the Virtual Frame Buffer in the current embodiment of the invention for backwards compatibility issues. The MPUxx interface is the VFB interface in this current embodiment. The signals depicted in Table 1 are defined as follows:

As used herein, nCS means Chip Select. When the nCS signal is active (low state), the host device is selecting the device to which the nCS signal is connected. In all but the MPUxx configuration, there must be an individual nCS signal for every device (other than the host) using this interface bus. When used in a raster interface, this signal is the DE or Data Enable signal. Because a raster interface is a continuous data stream interface, a signal (DE) is required to indicate when the streaming data is valid and when it is not.

As used herein, D/nC means Data/not Command. When used as A[0], and when this signal is high, the information on the I/F data bus, D[15:0], is video or graphics data. The device receiving the information on the I/F data bus will direct it to Ram. When this signal is low, the information on the I/F data bus, is either Command or Parameter information. Only the host is allowed to issue commands and parameters. The device receiving the information on the I/F data bus, when A[0] is low, will always direct it to the Virtual Frame Buffer control system 102 registers.

As used herein, Vsync (D/nC) is the new frame signal when used in a raster interface. An active state indicates a new frame of data will be transferred on the I/F data bus, D[15:0], when Vsync goes inactive.

As used herein, R/nW means Read/Write Selection. When the nWR signal is low, the host is driving data onto the I/F data bus. The receiving device should latch the data off the I/F data bus on the rising edge of nWR. When the R/nW signal is low, the host is driving data onto the I/F data bus. The receiving device should latch the data off the I/F data bus on the falling edge of the E signal. When the R/nW signal is high the host is reading data off the I/F data bus. The host will latch the data off the I/F data bus on the falling edge of the E signal while the transmitting device should begin driving the data onto the I/F data bus on the rising edge of the E signal. When used in the raster interface, R/nW is the Hsync signal. Hsync indicates a new line of data is being transferred on the bus.

As used herein, E means Read/Write Enable Strobe. When the nRD signal is low, the host is reading data off the I/F data bus. The transmitting device should be drive data onto the I/F data bus as long as this signal is low. The negative edge of the Read/Write Enable Strobe (E clock signal) is used to latch data off the I/F data bus. When the R/nW signal is low, the host is driving data onto the I/F data bus and the receiving device should latch the data off the I/F data bus on the falling edge of the E clock. When R/nW is high, the host is receiving data from the I/F data bus. The transmitting device should start driving data onto the I/F data bus on the rising edge of the E clock. The host will latch the data off the I/F data bus on the falling edge of the E clock.

As used herein, D[7:0] means the low order byte of the I/F data bus, while D[15:8] means the high order byte of the I/F data bus. D[15:0] is a bi-directional I/F data bus that may be used as a 1-bit, 4-bit, 8-bit, or 16-bit bus. Unused I/F data bus pins should be tied to ground. The number of data bits for this bus should be determined before the completion of power on reset.

As used herein, D[17:16] are supplemental bits for an 18-bit raster data bus. When used in a raster interface, the I/F data bus may be as wide as 18 bits. These two pins are used to expand the 16-bit bi-directional I/F data bus to an 18-bit uni-directional bus. For the raster interface, data can only be transferred from the host to the receiving device. The host may not read data via the I/F data bus, D[17:0], with a raster interface.

Figure 2:
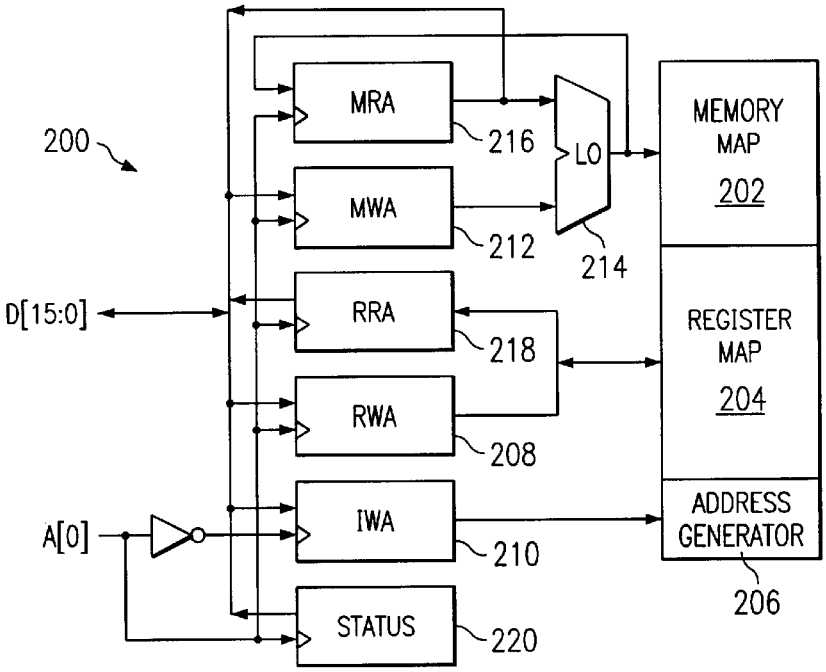
FIG. 2 is a simplified block diagram illustrating the display controller side of the interface for the scheme depicted in FIG. 1 and that is suitable for supporting both INTEL® 80 (MPU 80) and MOTOROLA® 68 (MPU 68) host CPU signaling protocols according to one embodiment of the present invention.

Looking now at FIG. 2, and with the signal definitions as defined above, a simplified block diagram 200 illustrates the display timing controller 106 side of the interface bus 112 for the scheme 100 depicted in FIG. 1 and that is suitable for supporting both INTEL® 80 (MPU 80) and MOTOROLA® 68 (MPU 68) host CPU signaling protocols according to one embodiment of the present invention. The MPU 80 and MPU 68 interfaces are rapidly becoming defacto standards in the display controller industry and are required for compatibility reasons. Both of these interfaces however, have some undesirable limitations. Table 2 below depicts signal protocols for the MPU 80 and MPU 68 interface schemes shown in FIG. 2.

TABLE 2

MPU 80/MPU 68 Signal Protocols

| MPU 80 | | | MPU 68 | | | |
|---|---|---|---|---|---|---|
| A[0] | nRD | nWR | A[0] | E | R/nW | Function |
| 1 | ↑ | 1 | 1 | ↓ | 1 | Read Memory (MRA)** |
| 1 | 1 | ↑ | 1 | ↓ | 0 | Write Memory (MWA)** |
| 1 | ↑ | 1 | 1 | ↓ | 1 | Read Register (RRA) |
| 1 | 1 | ↑ | 1 | ↓ | 0 | Write Register (RWA) |
| 0 | ↑ | 1 | 0 | ↓ | 1 | Read Status |
| 0 | 1 | ↑ | 0 | ↓ | 0 | Write Index (IWA) |

The double  means a dummy Read (DMRA) operation has to precede every MRA but not every MWA operation. Importantly, the Host 114 does not have direct access to either the registers or the memory; and both the Memory Map 202 and the Register Map 204 share the same address space. When a write operation occurs, the data will be directed to the location specified by the Address Generator 206. The Address Generator 206** will always index to the next address after the write operation is complete.

When writing to the Register Write Aperture (RWA) 208, the Host 114 may perform back to back sequential write operations, taking advantage of the auto increment feature of the Address Generator 206. After setting the Address generator 206 to the address of the first register which is written to via the Write Index Aperture (IWA) 210, the Host 114 may proceed to write the registers in sequential order. The Address Generator 206 will always auto increment after every RWA 208 operation.

When writing to the Memory Write Aperture (MWA) 212, a Logical Operation (LO) is always performed on the data. If the LO requires a memory read operation first, the Host 114 must first perform a dummy memory read operation to MRA 216 in order to route the existing data in memory to the Logical Operation unit 214 before performing the MWA 212 operation. In effect the Host 114 has to drive a Read-Modify-Write sequence. The Address Generator 206 will always auto increment after every MWA 212 operation.

When reading either the Memory Read Aperture (MRA) 216 or Register Read Aperture (RRA) 218, the Address Generator 206 will not be allowed to auto increment. The Host 114 has to reset the Address Generator 206, via IWA 210, with a new address position for every individual read operation. When reading the Memory Map 202, two back-to-back MRA 216 read operations are required. The first MRA 216 operation will load the content of memory into MRA 216 while the second operation will retrieve the valid data from MRA 216. During the first MRA 216 operation, the data retrieved by the Host 114 will be invalid. The Status aperture 220 will indicate the display line that the screen refresh controls are currently presenting to the display screen.

Figure 3:
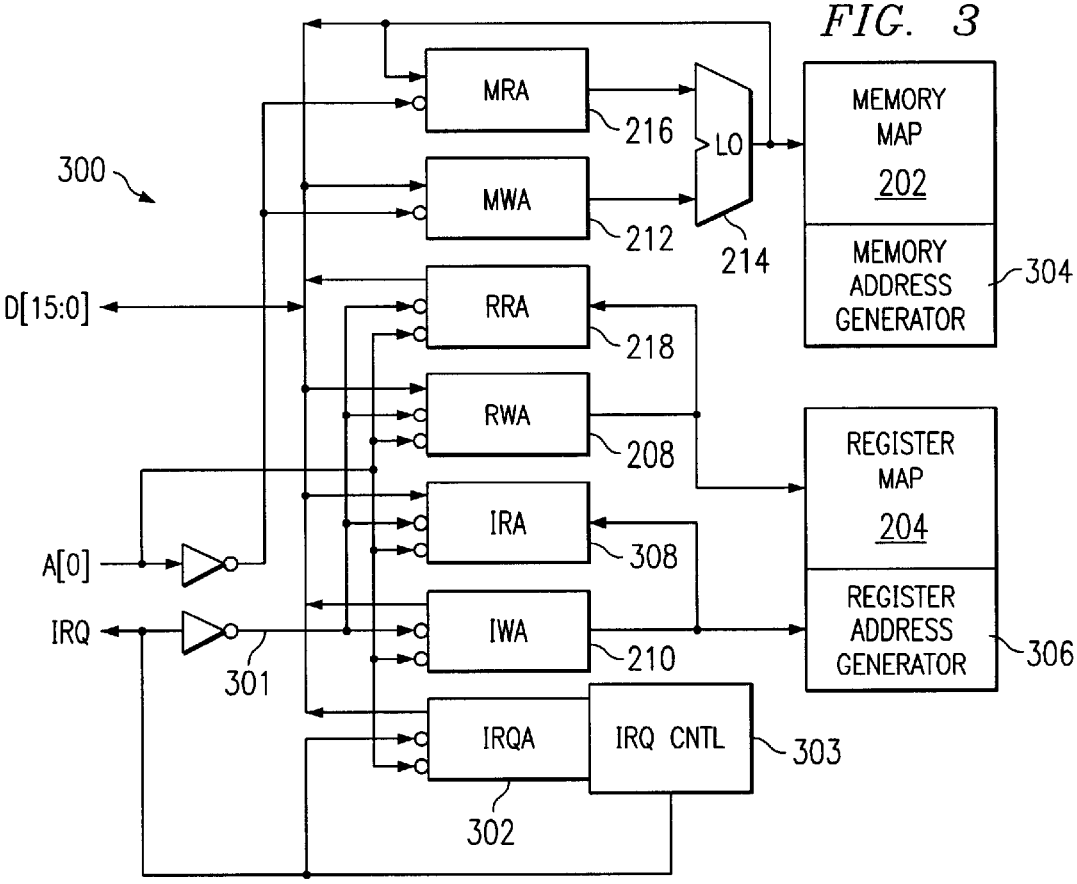
FIG. 3 is a simplified block diagram illustrating the display controller side of the interface for the scheme depicted in FIG. 1 and that is suitable for supporting a Texas Instruments LCD I/F (MPU xx) host CPU signaling protocol according to one embodiment of the present invention.

FIG. 3 is a simplified block diagram 300 illustrating the display timing controller 106 side of the interface bus 112 for the scheme 100 depicted in FIG. 1 and that is suitable for supporting a Texas Instruments LCD I/F (MPU xx) host CPU signaling protocol according to one embodiment of the present invention. The MPU xx interface provides a solution to the limitations that are inherent in the MPU 80 and MPU 68 interfaces depicted in FIG. 2, and also provides a way to accommodate gradual evolutionary interface function changes while maintaining the same signaling protocol. The MPU xx interface, as stated herein before, does not prevent or restrict graphic accelerators to be added at any time. Table 3 below depicts signal protocols for the MPU xx interface scheme shown in FIG. 3 using the signal definitions discussed herein before with respect to Table 1.

TABLE 3

MPU xx Signal Protocols

| MPU xx | | | | |
|---|---|---|---|---|
| A[0] | E | R/nW | IRQ | Function |
| 1 | ↓ | 1 | na | Read Memory Aperture (MRA) |
| 1 | ↓ | 0 | na | Write Memory Aperture (MWA) |
| 0 | ↓ | 1 | 0 | Read Register Aperture (RRA) |
| 0 | ↓ | 0 | 0 | Write Register Aperture (RWA) |
| 0 | ↓ | 1 | 0 | Read Index Aperture (IRA) |
| 0 | ↓ | 0 | 0 | Write Index Aperture (IWA) |
| 0 | ↓ | 1 | 1 | Read IRQ Aperture (IRQA) |

A number of differences can be distinguished between the MPU xx interface scheme associated with FIG. 2 and Table 2 when contrasted with the MPU 80 and MPU 68 interface schemes associated with FIG. 3 and Table 3. The MPU xx interface scheme 300, for example, has one additional signal and aperture, nIRQ 301 and IRQA 302 respectively, for use with touch screen controls. The NIRQ signal 301 is generated by the IRQ Controls 303 and cleared when IRQA 302 is read. The MPU xx interface scheme 300 also has independent address controls for the Register Address Generator 306 and Memory Address Generator 304 associated with the Register Map 204 and Memory Map 202 respectively. The Memory Address Generator 304 is controlled by register settings while the Register Address Generator is controlled by the IWA 210 setting. The MRA 216 and MWA 212 can hold a burst of up to 32 bytes of sequential data according to one preferred embodiment using the MPU xx interface scheme 300. The IRA 308 will always reflect the current value in the Register Address Generator 306, which is the next register to be presented to RRA 218 or loaded with RWA 208. Further, dummy read operations are not required for either LO 214 or MRA 216 operations using the MPU xx interface scheme 300.

Figure 4:
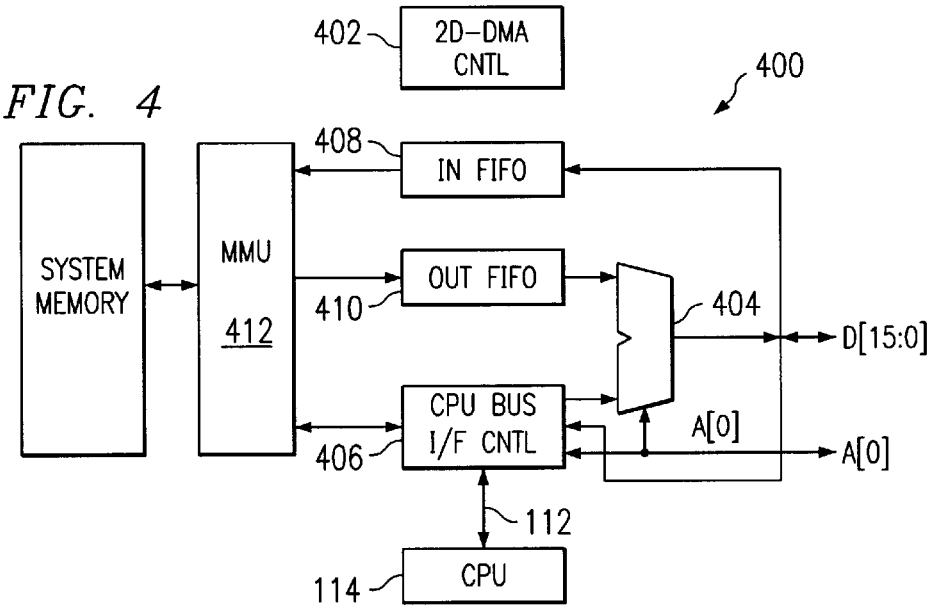
FIG. 4 is a simplified system block diagram illustrating use of a MPU xx interface to allow a 2D-DMA controller to work in concert with a CPU to manage data flow on a Virtual Frame Buffer control system I/F according to one embodiment of the present invention.

Importantly, the MPU xx interface scheme 300 is designed to allow a 2D-DMA controller to work in concert with the Host 114 in managing the data on the Virtual Frame Buffer control system I/F Bus 112. FIG. 4 is a simplified system block diagram 400 illustrating use of a MPU xx interface scheme 300 to allow a 2D-DMA controller 402 to work in concert with a CPU 114 to manage data flow on a Virtual Frame Buffer control system I/F according to one embodiment of the present invention. Whenever the CPU 114 needs to modify the content of any register in the Virtual Frame Buffer control system 102, it will drive the A[0] signal low. The output multiplexer 404 will select the data bus from the CPU Bus I/F Controller 406 as the source of output data on the Virtual Frame Buffer control system I/F D[15:0] data bus and the CPU Bus I/F Controller 406 as the destination for all input data. The CPU Bus I/F Controller 406 will in turn direct the data to or from the CPU 114. If A[0] is high, the data on the D[15:0] data bus is display data and will be directed either into or out of one of the appropriate FIFO buffers, In FIFO 408 and Out FIFO 410 respectively. The 2D-DMA Controller 402 and Memory Management Unit (MMU) 412 will work in concert to keep the Out FIFO buffer 410 full on data outputs and the In FIFO buffer 408 empty on data inputs.

Figure 5:
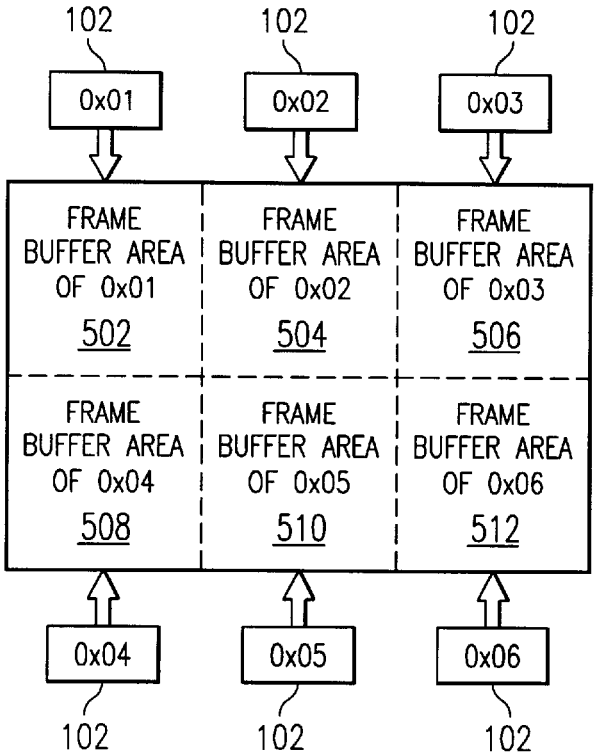
FIG. 5 is a simplified block diagram illustrating how six Virtual Frame Buffer control systems may be cascaded to drive the columns of a display panel that is much too large for a single Virtual Frame Buffer control system to handle.

FIG. 5 is a simplified block diagram 500 illustrating how six Virtual Frame Buffer control systems (devices) 102 may be cascaded to drive the columns and rows of a 2-D area of a display panel that is much too large for a single Virtual Frame Buffer control system 102 to handle. In order to support a wide range of display resolutions, the Virtual Frame Buffer control system 102 architecture is designed to allow multiple Virtual Frame Buffer control systems 102 to share the same Virtual Frame Buffer control system 102 I/F Bus 112. According to one embodiment, up to eight devices 102 may share the same I/F Bus 112. All devices 102 must adhere to a particular set of design rules discussed herein below when multiple devices 102 share the same I/F Bus 112.

First, when the host processor 114 is addressing register space, each device 102 being addressed will be identified in the content of the last IWA 210 operation. The eight MSB's of the Index Write Aperture (IWA) 210 are used to identify the device 102 being addressed. Each device 102 will be assigned a configuration identity (e.g., 0×01, 0×02, 0×04, 0×08, 0×10, 0×20, 0×40, 0×80) via a power-on configuration mechanism. This is generally done with configuration pins that are read during power-on reset, although it will readily be appreciated the present invention is not so limited, and other techniques may also be employed to assign configuration identities. The eight MSB's of every IWA 210 operation are logically ANDed with the devices' respective configuration identities. If the result of the AND operation is not zero, the respective device 102 will respond to all register space read or write operations. Because all devices 102 have the same internal register space mapping, the host processor 114 may broadcast register settings by setting the eight MSB's in the IWA 210 to 0×FF. The host 114 must also take care and verify that only one device 102 is selected (i.e. the eight MSB's of the IWA 210 are set to only one of the following values: 0×01, 0×02, 0×04, 0×08, 0×10, 0×20, 0×40 or 0×80, when using the respective configuration identities set forth above) before performing any register read operations.

Second, every IWA 210 operation will modify every IWA 210 in every device 102 so that all devices 102 in the system will always have the same value in their respective IWA's 210.

Third, only one device 102 in any design is allowed to generate and respond to a nIRQ signal 301. The IRQ acknowledge operation 302 of each device 102 has to be programmably enabled before it can respond to the IRQ acknowledge 302 timing protocol.

Finally, when the host processor 114 is addressing memory space, all devices 102 must monitor the system I/F Bus 112 and respond accordingly when data for their memory is on the data bus portion of the system I/F Bus 112.

With continued reference to FIG. 5, each device 102 contains ⅙ of the required memory necessary to store the content of the displayed image. Each device 102 must monitor the system I/F Bus 112 and determine independently when the data on the data bus portion of the system I/F Bus 112 is to be read from or written to the Frame Buffer 502, 504, 506, 508, 510, 512 to which its respective embedded memory is mapped.

In summary explanation of the foregoing, a virtual frame buffer is central to providing cascading support such that when addressing display memory, the host processor sees only one two-dimensional memory array, even though this memory array may be distributed in several devices 102.

Figure 6:
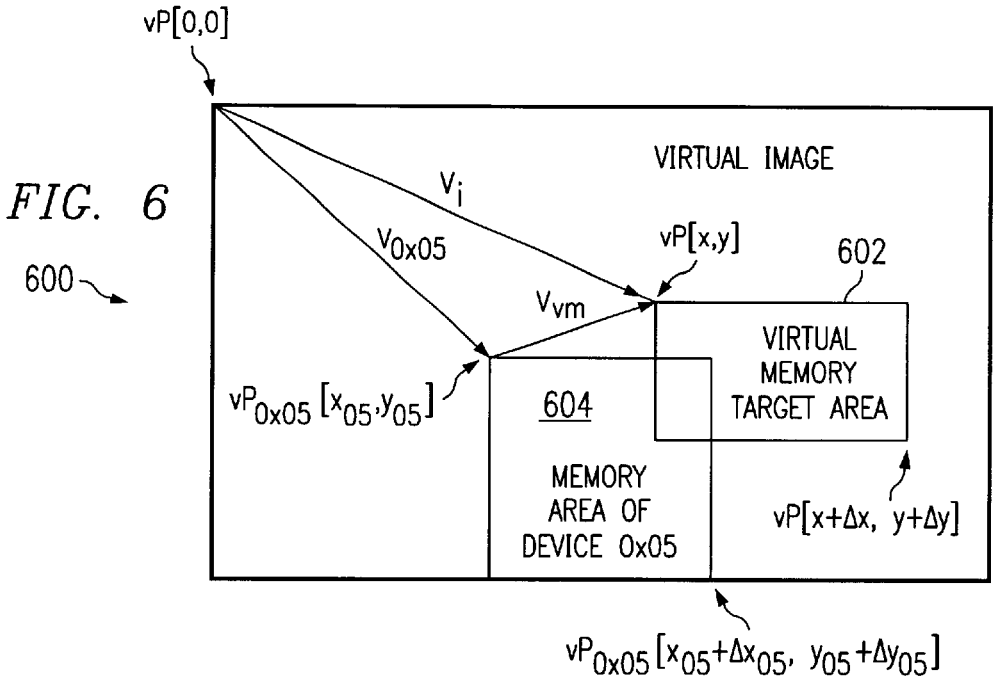
FIG. 6 illustrates a graphical model depicting operation of a Virtual Frame Buffer according to one embodiment of the present invention.

FIG. 6 is a graphical model illustrating operation of a Virtual Frame Buffer 600 according to one embodiment of the present invention. A target area 602 in the virtual frame buffer 600 defined by vP[x,y] and vP[x+Δx,y+Δy] is the area that the host 114 wishes to address. Using a host 114 memory write operation as the model, the host 114 will stream data onto the data bus portion of the I/F Bus 112 from pixel position vP[x,y] to pixel position vP[x+Δx,y+Δy] line by line. A portion of this target area 602 resides in the internal memory of a Virtual Frame Buffer control system (device) 102 configured as the fifth (0×05) device 102 in the array of cascaded devices 102. Device (0×05) is required to know what portion of the target area 602 overlays its own internal memory 604, and must be able to capture from the continuous stream of data, that portion of the data stream that should be stored in its own internal memory area 604. The Virtual Pixel defined as $vP_{0\times05}[x_{05},y_{05}]$ is the same as Absolute Pixel $P[X_0,Y_0](X_0=0,Y_0=0)$ in device 0×05. The Virtual Pixel defined as $vP_{0\times05}[x_{05}+\Delta x_{05},y_{05}+\Delta y_{05}]$ is the same as Absolute Pixel $P[X_{max},Y_{max}]$ in device 0×05. The Virtual mapping registers in device 0×05 will be set with the following settings in which the values are relative to Virtual Pixel vP[0,0] in pixel units.

Absolute Pixel $X_0$(APXS)=$X_{05}$

Absolute Pixel $Y_0$(APYS)=$Y_{05}$

Absolute Pixel $X_{max}$(APXE)=$X_{05}+\Delta X_{05}$

Absolute Pixel $Y_{max}$(APYE)=$Y_{05}+\Delta Y_{05}$

When the host processor 114 wishes to address a target area 602 in the Virtual Frame Buffer 600, it will define that area in terms of Virtual pixels. All devices 102 in the system including device 0×05 will have their Virtual Target mapping registers programmed with the same values below which are relative to Virtual Pixel vP[0,0] in pixel units.

Virtual Target X Start (VTXS)=x

Virtual Target Y Start (VTYS)=y

Virtual Target X End (VTXE)=x+Δx

Virtual Target Y End (VTYE)=y+Δy

The Virtual Target Start and End control (VTXS, VTYS, VTXE, VTYE) will control a virtual pixel counter. The output of the virtual pixel counter has two values associated with a virtual X or column value (VPX) and a virtual Y or row value (VPY). When the target area 602 data conditions given below are met on the device 102 I/F Bus 112, device 0×05 will capture into its internal memory the data off the I/F Bus 112.

$APXS \leqq VPX \leqq APXE;\ APYS \leqq VPY \leqq APYE$

The absolute memory location in device 0×05 in which this data will be stored is calculated accordingly in which values are relative to Absolute Pixel $P[X_0,Y_0]$ in pixel units.

Absolute Pixel X(APX)=APX−APXS

Absolute Pixel Y(APY)=APY−APYS

The data will be stored at the memory address specified by APX and APY in device 0×05.

In view of the foregoing, it can be appreciated the present invention presents a significant advancement in the art of LCD display panel controls. Further, this invention has been described in considerable detail in order to provide those skilled in the data communication art with the information needed to apply the novel principles and to construct and use such specialized components as are required. In view of the foregoing descriptions, it should be apparent that the present invention represents a significant departure from the prior art in construction and operation. However, while particular embodiments of the present invention have been described herein in detail, it is to be understood that various alterations, modifications and substitutions can be made therein without departing in any way from the spirit and scope of the present invention, as defined in the claims that follow. For example, although various embodiments have been presented herein with reference to particular functional architectures and algorithmic characteristics, the present inventive structures and methods are not necessarily limited to such a particular architecture or set of characteristics as used herein.

What is claimed is:

1. A display control system comprising:

a plurality of subsystems each comprising:

a display timing controller;

a display memory;

a plurality of source drivers; and a clipping controller in communication with a data bus, wherein the clipping controller is operational to monitor two-dimensional image data streaming across the data bus, identify the two-dimensional image data as being a portion of data associated with a virtual frame buffer and transfer only the portions of the two-dimensional image data associated with the virtual frame buffer into the display memory such that the display timing controller and plurality of source drivers operate to drive only a portion of a display panel, wherein each subsystem drives a portion of the display concurrently and continuously.

2. The display control system according to claim 1 wherein each source driver is associated with a column of the display panel.

3. The display control system according to claim 1 wherein the clipping controller is further operational to interface the display control system with a plurality of different signaling protocols.

4. The display control system according to claim 1 further comprising a host data processing device operational to generate the two-dimensional image data streaming across the data bus, wherein the host data processing device is selected from the group consisting of a CPU, computer, micro-computer, micro-controller, and digital signal processor.

5. The display control system according to claim 1 wherein the display panel is an LCD panel.

6. The display control system according to claim 1 wherein the display panel is an Organic Light Emitting Diode panel.

7. The display control system according to claim 1 wherein the display panel is a Flat Panel.

8. A display control system comprising:

a plurality of subsystems, each subsystem operable to drive a portion of the display concurrently and continuously, the first subsystem comprising:

a first display timing controller;

a first display memory;

a first plurality of source drivers; and interfacing means in communication with a data bus for monitoring two-dimensional image data streaming across the data bus, identifying portions of the two-dimensional image data associated with a virtual frame buffer and transferring only the portions of the two-dimensional image data associated with the virtual frame buffer into the first display memory such that the first display timing controller and first plurality of source drivers operate to drive only a first portion of a display panel.

9. The display control system according to claim 8 wherein the first plurality of source drivers are configured to drive columns associated with the display panel.

10. The display control system according to claim 8 wherein the interfacing means comprises a clipping controller.

11. The display control system according to claim 8 wherein the interfacing means is further operational to interface the display control system with a host device via a plurality of different signaling protocols selected from the group consisting of INTEL 80 I/F, MOTOROLA 68 I/F, TEXAS INSTRUMENTS LCD I/F, and straight raster signaling I/F.

12. The display control system according to claim 8 wherein the display panel is an LCD display panel.

13. The display control system according to claim 8 wherein the display panel is a Flat display panel.

14. A method of controlling a display panel comprising:

providing a display control system comprising a plurality of subsystems, each subsystem operable to drive a portion of the display concurrently and continuously, the first subsystem comprising:

a first display timing controller;

a first display memory;

a first plurality of source drivers; and interfacing means;

interfacing the display control system with a host processor data bus;

monitoring two-dimensional image data streaming across the data bus;

identifying portions of the two-dimensional image data associated with a virtual frame buffer; and transferring only the portions of the two-dimensional image data associated with the virtual frame buffer into the first display memory such that the first display timing controller and first plurality of source drivers operate to drive only a first portion of a display panel.

15. The method according to claim 14 wherein the first portion of a display panel is associated with columns of the display panel.

16. The method according to claim 14 wherein the step of interfacing the display control system with a host processor data bus comprises interfacing the display control system with an INTEL 80 CPU I/F.

17. The method according to claim 14 wherein the step of interfacing the display control system with a host processor data bus comprises interfacing the display control system with a MOTOROLA 68 CPU I/F.

18. The method according to claim 14 wherein the step of interfacing the display control system with a host processor data bus comprises interfacing the display control system with a TEXAS INSTRUMENTS LCD I/F.

19. The method according to claim 14 wherein the step of interfacing the display control system with a host processor data bus comprises interfacing the display control system with a straight raster signaling I/F.

20. The method according to claim 14 where the interfacing means comprises a clipping controller.

21. The method according to claim 14 wherein at least one of the subsystems other than the first subsystem comprises:

at least one additional display timing controller;

a respective display memory associated with each additional display timing controller;

a respective plurality of source drivers associated with each additional display timing controller; and a respective interfacing means associated with each additional display timing controller;

and further comprising monitoring the two-dimensional image data streaming across the data bus to identify portions of the two-dimensional image data associated with a respective portion of the virtual frame buffer associated with each additional display timing controller; and transferring only the portions of the two-dimensional image data associated with each respective portion of the virtual frame buffer into its respective display memory such that each additional display timing controller and its respective plurality of source drivers operate to drive only a portion of the display panel associated with its respective portion of the virtual frame buffer.

22. The method according to claim 14 wherein the display panel is an LCD display panel.

23. The method according to claim 14 wherein the display panel is a Flat display panel.

* * * * *